US008459839B2

(12) United States Patent
Wakalopulos

(10) Patent No.: US 8,459,839 B2
(45) Date of Patent: Jun. 11, 2013

(54) HAND HELD, HIGH POWER UV LAMP

(75) Inventor: George Wakalopulos, Pacific Palisades, CA (US)

(73) Assignee: Adastra Technologies, Inc., Torrance, CA (US)

( * ) Notice: Subject to any disclaimer, the term of this patent is extended or adjusted under 35 U.S.C. 154(b) by 332 days.

(21) Appl. No.: 13/020,688

(22) Filed: Feb. 3, 2011

(65) Prior Publication Data

US 2011/0140604 A1 Jun. 16, 2011

Related U.S. Application Data

(63) Continuation-in-part of application No. 12/751,606, filed on Mar. 31, 2010, now Pat. No. 8,277,138, and a continuation-in-part of application No. 12/478,970, filed on Jun. 5, 2009, now Pat. No. 8,308,313, and a continuation-in-part of application No. 12/209,080, filed on Sep. 11, 2008, now Pat. No. 7,731,379, and a continuation-in-part of application No. 12/112,753, filed on Apr. 30, 2008, now Pat. No. 7,775,690.

(51) Int. Cl.
*F21V 33/00* (2006.01)

(52) U.S. Cl.
USPC ..... 362/265; 362/263; 362/264; 315/76

(58) Field of Classification Search
USPC ..... 362/263, 264, 265; 315/76
See application file for complete search history.

(56) References Cited

U.S. PATENT DOCUMENTS

| | | | | |
|---|---|---|---|---|
| 4,975,300 | A | 12/1990 | Deviny | |
| 5,003,185 | A | 3/1991 | Burgio, Jr. | |
| 5,828,182 | A * | 10/1998 | Shannon et al. | 315/171 |
| 6,361,194 | B1 | 3/2002 | Evans et al. | |
| 6,716,305 | B2 | 4/2004 | Green et al. | |
| 6,739,716 | B2 | 5/2004 | Richards | |
| 6,761,127 | B2 | 7/2004 | Field et al. | |
| 6,953,940 | B2 | 10/2005 | Leighley et al. | |
| 7,344,272 | B2 | 3/2008 | Cooper et al. | |
| 2009/0092764 | A1 | 4/2009 | Hoeckelman | |
| 2009/0272320 | A1 | 11/2009 | Wakalopulos | |
| 2009/0273266 | A1 | 11/2009 | Wakalopulos | |
| 2009/0273936 | A1 | 11/2009 | Wakalopulos | |
| 2009/0301027 | A1 | 12/2009 | Pelletier et al. | |
| 2010/0209621 | A1 | 8/2010 | Wakalopulos | |

* cited by examiner

*Primary Examiner* — Laura Tso
(74) *Attorney, Agent, or Firm* — Schneck & Schneck; Thomas Schneck

(57) ABSTRACT

A UV curing lamp has variable resistive ballast provided by at least one resistance alloy wire and a set of switches tapping varying positions along the resistance alloy wire. The variable resistance ballast defines the lamp's maximum operating power consistent with the power supply. The wire in combination with a fan also doubles as thermal ballast provided by air flowing across the wire onto the UV lamp. A detachable reflector in a generally parabolic cylinder shape directs light from the lamp located on the reflector's focal axis. The curing lamp with resistive ballast can be in the form of a handheld unit or as a floor unit with rotating lamps within the housing.

25 Claims, 6 Drawing Sheets

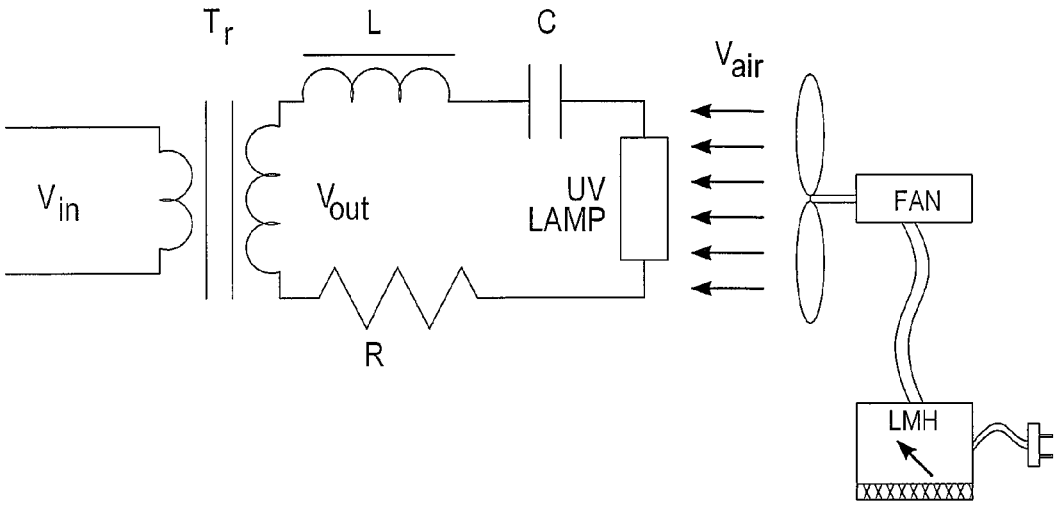
*Fig. 1* *(Prior Art)*
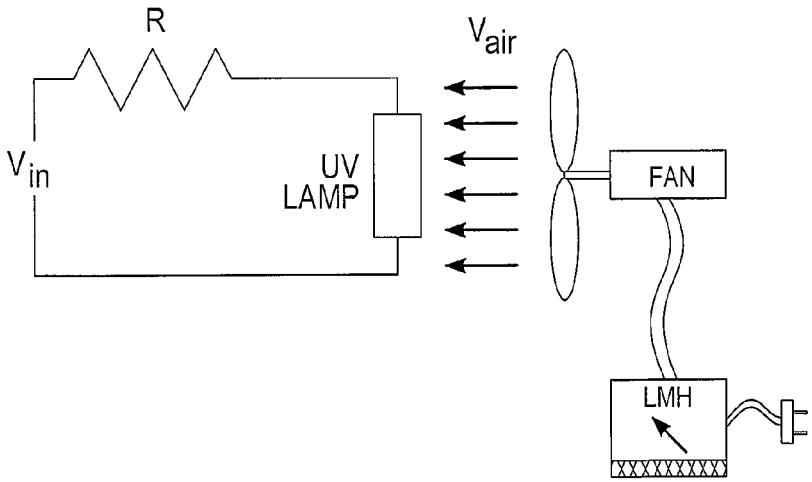
*Fig. 2* *(Prior Art)*

Fig. 7
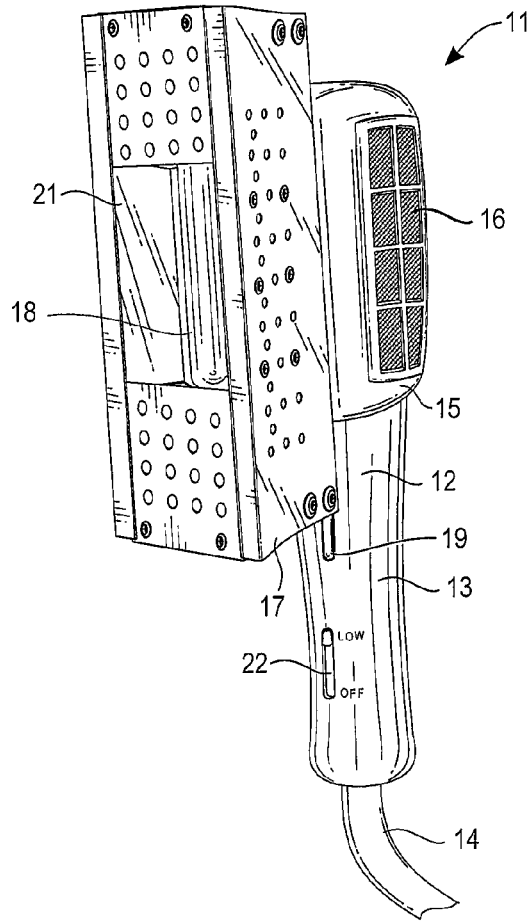
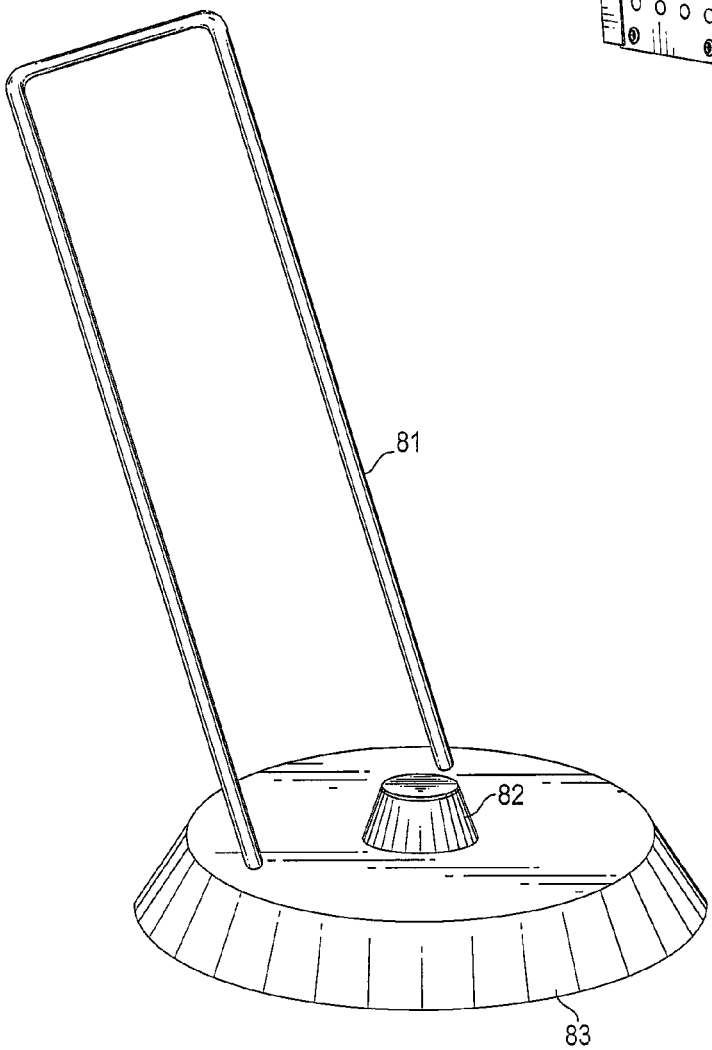
Fig. 8

HAND HELD, HIGH POWER UV LAMP

CROSS-REFERENCE TO RELATED APPLICATIONS

This application is a continuation-in-part of prior U.S. application Ser. No. 12/751,606, filed Mar. 31, 2010, in turn a continuation-in-part of U.S. application Ser. No. 12/478,970, filed Jun. 5, 2009, in turn a continuation-in-part of U.S. application Ser. No. 12/209,080, filed Sep. 11, 2008, now U.S. Pat. No. 7,731,379, which in turn is a continuation-in-part of U.S. application Ser. No. 12/112,753, filed Apr. 30, 2008.

TECHNICAL FIELD

The invention relates to portable, moderately high power, ultraviolet lamps.

BACKGROUND OF THE INVENTION

Beams of high intensity ultraviolet (UV) light are useful for curing polymers in coatings, inks, adhesives and the like, and for other purposes. A known reliable source of UV light at good power is the mercury vapor lamp. Almost all of the world's artificial lighting comes from mercury lamps, mainly due to their efficiency and low cost. For the same reason, mercury lamps have been the staple of the UV curing industry for many decades.

Mercury lamps powered by heavy transformer ballasts, once used only in factory installations, are now appearing in on-site UV curing applications. New waterborne and dual-cure UV coating technologies are also expanding UV curing from factory to the jobsite. Bathtubs, countertops, floors, walls, etc., are now finished and re-finished quickly in the field, with conventional curing equipment. Lighter, simpler, and more practical needs along with recent economic and environmental concerns are driving the demand for more portable lower cost UV systems. Lower cost and portability will drive the equipment side of the UV curing market, while appearance, durability, and applicability will dominate coatings.

A ballast circuit is used with gas or vapor discharge lamps to control their power usage and prevent runaway overloading of the power supply. Ballasts can include resistors, capacitors, inductors, transformers or a combination of these, as well as electronic circuits where the power to the lamp is controlled by high frequency switching techniques. Today the most widely used and heaviest part of the ballast for the lamps in UV curing equipment is the transformer.

While ordinary fluorescent lamps for lighting need only small ballasts due to their low power, typical UV curing lamps use tens or hundreds of watts per centimeter of length, requiring high-power ballasts rated at 1 to 40 kW. Magnetic transformer ballasts use iron cores. Their weight in kilograms (kg) is approximately 5.4 P+18, where P is the power in kW. The most common power source is the 120 volt 15 Amp residential outlet delivering a maximum of 1.8 kW. Other electrical outlets deliver 220 volt at 15, 20, 30 and 50 amps, respectively delivering a maximum of 3.3 kW, 4.4 kW, 6.6 kW, and 11 kW of power to the lamp. Typical UV lamps operating at these power levels require magnetic ballasts that will weigh approximately 28, 36, 42, 54, and 77 kg, respectively. The entire system, however, can weigh more. This limits the portability of the UV curing equipment.

Electronic ballasts offer an alternative to the heavy magnetic ballast. 3.5 kW compact electronic ballasts are now available in the marketplace weighing less than 7 kg, but their cost is significantly higher than their magnetic ballast counterparts. Resonant and hybrid technologies, offer equipment at more moderate weights and prices.

In a prior handheld UV curing device of the present inventor, the electrical ballast is a resistance wire (e.g., of Nichrome®). The resistance wire also doubles as thermal ballast for the lamp. Air from a fan is blown across the wire in a path that takes the air past the lamp. A curved elongated optical reflector associated with the lamp is split so that air can enter a plenum defined by the reflector wherein the lamp is mounted axially. Whenever the lamp is cold, air heated by passing over the resistive wire of the ballast heats the lamp toward its operating temperature. When the lamp temperature exceeds the temperature of the wire, the airflow then acts to cool the lamp. This arrangement tends to stabilize the lamp's thermal performance, and since the voltage across an electrical discharge is dependent upon the gas pressure and thus upon the lamp's temperature, the arrangement also stabilizes the lamp's electrical performance.

For UV outputs of over 40 W/cm with beam widths up to 12 cm and at a curing distance of 3 to 5 cm, large housings are used to provide room for the UV lamp, ballast circuitry, and any cooling structures. What is needed is a lightweight ballast circuit for a moderate power UV lamp that can be used in a portable curing apparatus. A portable, even handheld, device would offer both speed and precision for curing of polymer coatings on surfaces of all shapes.

SUMMARY OF INVENTION

An ultraviolet beam generating apparatus is provided with variable-resistance ballast electrically connected to one or more mercury vapor discharge lamps in a reflective lamp housing. The resistance is selected as a function of lamp voltage to counterbalance the decreased resistance within the lamp discharge as operating power and temperature increases. The variable resistance ballast may have a set of switches that selectively choose from a set of resistances (e.g., R, R/2, R/4 and R/8) based on the lamp operative voltage and power. The resistor material may be nickel-chromium resistance alloy wire. The heating of the resistor element may also serve in combination with a fan as thermal ballast for temperature control of the lamp.

BRIEF DESCRIPTION OF THE DRAWINGS

FIG. 1 is a schematic equivalent circuit diagram of a typical magnetic ballast for use with a mercury lamp.

FIG. 2 is a schematic circuit diagram for a resistive ballast.

FIGS. 7 and 8 are perspective views of a hand held ultraviolet beam generator and a corresponding floor model in accordance with the present invention.

BEST MODE OF THE INVENTION

The voltage across a gas discharge increases with distance and gas pressure. A mercury lamp contains low-pressure gas (typically argon) with a small amount of mercury. Current passing through the lamp increases its temperature evaporating the mercury causing its pressure to rise resulting in an increase in voltage across the lamp. The maximum lamp voltage occurs when all the mercury is in the vapor state and/or when the lamp is operating at its operating temperature (600-900° C.).

Typical power of about 70 W/cm is available from a mercury lamp within a few minutes after starting. At start-up a small pool of mercury is vaporized and heated. The lamp is a negative resistance coefficient device (resistance decreases with increasing operating power and temperature), requiring ballast to prevent increasing current from damaging the lamp. The decreased resistance is offset by ballast impedance that tends to limit current. As the lamp heats up during operation, internal gas pressure rises and a higher voltage is required to maintain the discharge. The resistive drop across the ballast supplies the required voltage until the required voltage cannot be supplied to maintain the discharge. At that point, the discharge is extinguished, the lamp cools, the gas pressure is reduced and the ballast is again effective once the lamp is started. An auxiliary high voltage electrode is used to restart the arc discharge.

Magnetic Ballast

FIG. 1 shows a simplified equivalent circuit of typical magnetic ballast for a mercury lamp. A transformer steps up the input voltage to approximately twice the lamp voltage to ignite the lamp. The lamp current I is limited by the circuit impedance $Z=[R^2+(X_L-X_C)]^{1/2}$, where R is the resistance of the wire in the circuit, $X_L=2\pi fL$ and $X_C=(2\pi fC)^{-1}$, L is the inductance of the ballast transformer, C is the capacitance, and f is the line frequency (60 Hz). The circuit has a resonance at $X_L=X_C$, where the current peaks. Changing the capacitor value C varies the current or power of the lamp. When the lamp reaches its operating temperature and voltage, a fan keeps the lamp from overheating. At this point a constant current is maintained with an autotransformer or constant wattage, ballast with series capacitor. Power (lamp voltage times current) is maintained constant even with voltage and current variations resulting from lamp aging.

Resistive Ballast

FIG. 2 shows a resistive ballast circuit. Unlike the magnetic ballast circuit of FIG. 1, the current I drops as the lamp voltage $V_{lamp}$ increases, $I=(V_{in}-V_{lamp})/R$. For a constant resistance R, the steady state voltage of the lamp depends on its cooling parameters. Thus the cooling provided by forced convection from the fan is an important parameter in resistive ballasts and in combination with the series resistance define the prime control parameters that determine the lamps operating point on the load line.

Figure 3:
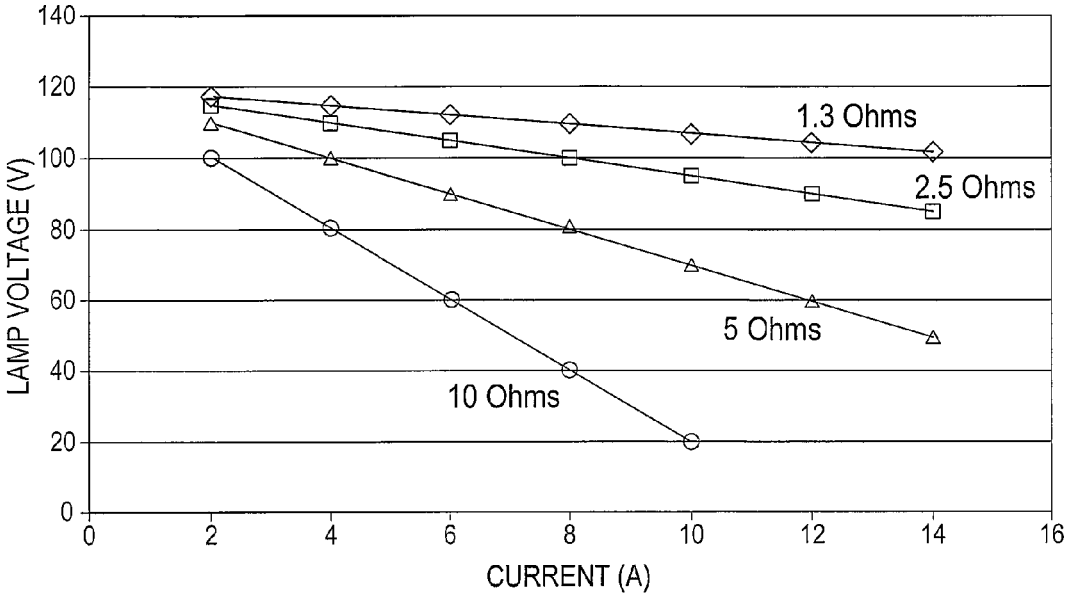
FIG. 3 is a graph of lamp voltage versus current relationship using a resistive ballast as in FIG. 2 and with a 120-volt AC input for various ballast resistances (1.3, 2.5, 5.0 and 10.0 ohms).

FIG. 3 illustrates the lamps voltage-current relationship as a function of ballast resistance at an input voltage of 120 volts AC. For a fixed resistance, the lamp's operating point cannot be easily determined since the lamp's voltage depends on the amount of mercury evaporated, which depends on the lamp's temperature. With forced air-cooling, the lamp will reach a voltage determined by its input power balanced by its power loss from, radiative and convective cooling. Unlike a magnetic ballast where the lamp voltage reaches a fixed value when the mercury is completely evaporated, a resistive ballast becomes more efficient when the lamp's voltage approaches the input voltage. Should the lamp's voltage exceed the input voltage, the lamp will extinguish. We now investigate the parameters that influence the lamp's potential drop.

Lamp Voltage

A mercury lamp with a series resistance (R) connected to a voltage ($V_{in}$), has an initial voltage drop of approximately 15 volts and its current increases to $(V_{in}-15)/R$. This voltage drop is associated with the energy required to emit electrons from the metal electrodes into the gas. The voltage (V/cm) across the length of the tube depends on the amount of mercury evaporated and is $V_{lamp}=m^{7/12}d^{-3/2}$, where m is the amount of mercury (mg/cm) and d is the tube diameter (cm). The vapor pressure P of mercury (kPa) is a function of temperature T (K) and can be expressed as $P=7.58\times10^{-1}\,T+3.9\times10^{-3}\,T^2+4.8\times10^{-6}\,T^3$. The pressure for an ideal gas is P=nRT/Vo, where n is the amount of evaporated mercury (moles), R is the gas constant (8.31 kPa L/K mol), and Vo is the gas volume in liters), with the mercury vapor pressure from above and substituting for the amount of mercury (moles), the lamp's steady state temperature (for a typical 7.5 cm lamp, d=2 cm) as a function of total lamp voltage (V) can be expressed as, $$T(K)=6V+390,\ \text{for } V>15 \tag{1}$$

The lamp's steady state envelope temperature can also be determined from power balance considerations as follows.

Lamp Temperature

To determine the lamp's operating temperature we look at the power loss from $$Q_{input}=Q_{convection}+Q_{radiation\text{-}lamp}+Q_{ballast}+Q_{radiation\text{-}arc} \tag{2}$$

where $Q_{convection}$ and $Q_{radiation\text{-}lamp}$ are the power of the lamp lost by convection and radiation, respectively. The convective heat loss depends on the Nusselt number (Nu) as $$Q_{convection}=Nuk(T_s-T_{air})A/D \tag{3}$$

where k is the thermal conductivity of air, $T_s$ is the lamp's surface temperature (° C.), $T_{air}$ is the surrounding air temperature (° C.), A is the lamp's surface area, and D is the lamp's diameter. For forced convection, the Nusselt number is $$NU_{forced}=0.3+0.62R_{ed}^{1/2}Pr^{1/3}\{[1+(0.4/Pr)^{2/3}]^{1/4}\}^{-1}\{[1+(R_{ed}/282200)^{5/8}]^{4/5}\} \tag{4}$$

where $R_{ed}$ is the Reynold number and Pr is the Prandtl number. The power lost by radiation is $$Q_{radiation}=\acute{\epsilon}A\sigma(T_s^4-T_{air}^4 \tag{5}$$

where $\acute{\epsilon}$ is the emissivity of quartz (0.93), A is the surface area, and σ is the Stefan-Boltzmann constant.

Assuming $T_{air}$=300K and that the non-radiative loss heating the quartz lamp is nearly equal to ⅓ of the input power ($V_iI$), by combining equations 2, 3, 4, and 5, and the ballast power ($I_2R$) and substituting in equation 1, for a 7.5 cm lamp, $$V_iI=A(6V+112)+B((6V+390)^4-300^4)+I_2R+2V_iI/3 \tag{6}$$

where A=Nu k A/D, B=$\acute{\epsilon}$ A σ, and R is the series resistance. This can be solved numerically for voltage (V) as a function of current (I). The lamp's steady state V-I characteristics can now be determined by gas flow and external circuit parameters. By combining this with the load lines in FIG. 3, we can determine the lamp's operating point for a given gas flow and load resistance.

Figure 4:
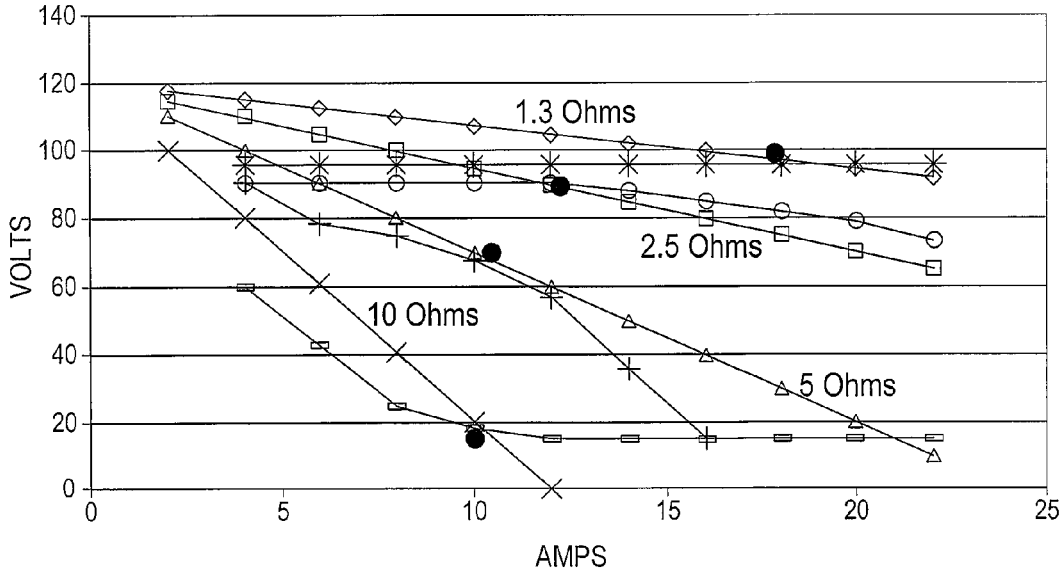
FIG. 4 is a graph overlaying the voltage versus current relationship of FIG. 3 with load lines for a 7.5-cm lamp and 1 m/s gas cooling to obtain at intersections (large white dots) the lamp's steady-state operating points.

FIG. 4 shows steady state lamp operating points as a function of resistance for a 7.5 cm UV lamp operating with a 120 VAC power supply. The straight lines from top to bottom are the ballast resistance curves from FIG. 3 with ballast resistance of 1.3, 2.5, 5 and 10 ohms, respectively. The intersection of these curves with the V-I characteristics of the mercury discharge is indicated by the white dots. These are the lamp's operating points at a gas flow of 1 m/sec. It is evident that for these points dV/dI+R>0 and thus represent a net positive impedance, i.e., the overall impedance is positive and therefore implies a stable operating point. The final lamp's voltage can now be tuned by adjusting gas-cooling parameters.

Ballast Design

Figure 6A:
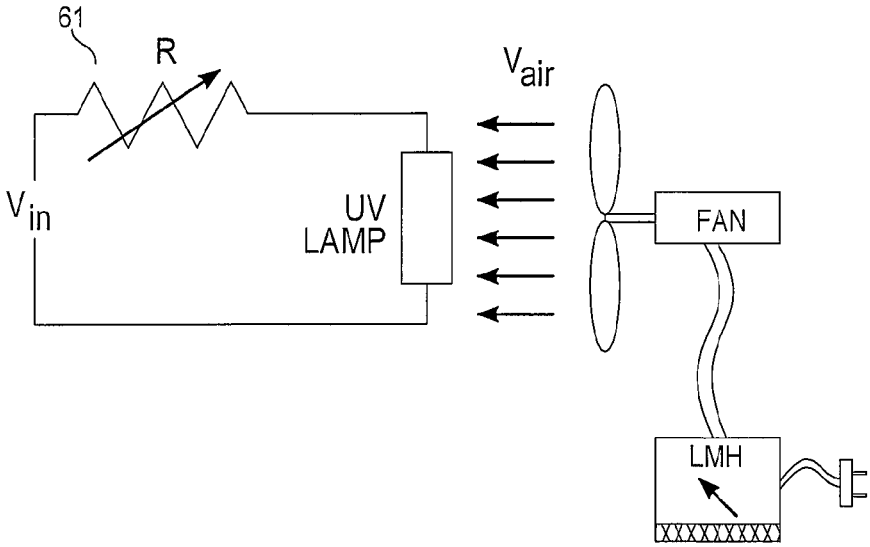
FIG. 6A is a schematic circuit diagram of a variable resistance ballast in accord with the present invention.
Figure 6B:
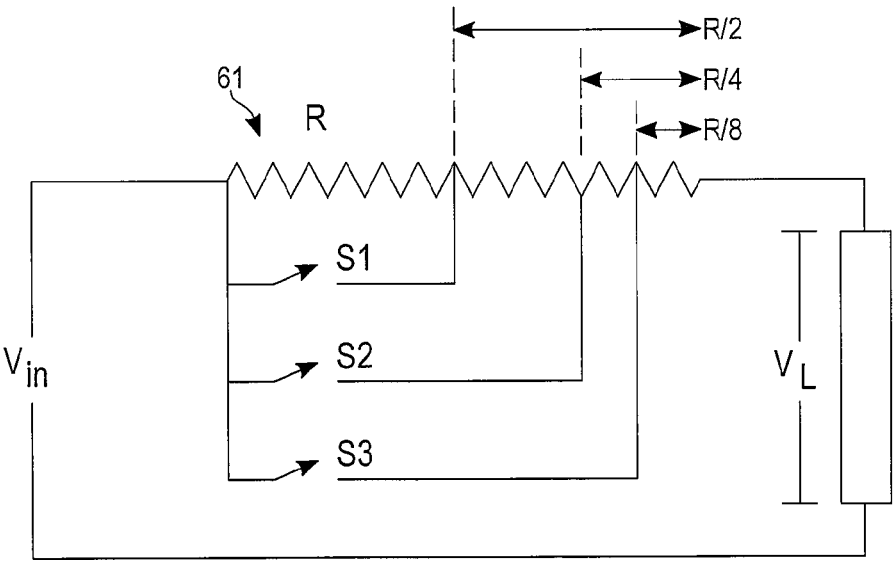
FIG. 6B is a more detailed schematic illustrating an embodiment of the variable resistor in the ballast of FIG. 6A.

With reference to FIGS. 6A and 6B, to maintain a constant current with a resistor requires variable resistance ballast 61. A simple method is to reduce the resistance R in half each time (R/2, R/4, R/8) by a series of switches S1-S3 switched at predetermined lamp voltage levels calculated not to exceed maximum ballast power limits. By expressing lamp voltage as percentage of input voltage $V_L$=% $V_i$/100, $\Delta V=V_i-V_L$, $I=\Delta V/R$, $P_B=I^2R=\Delta V^2/R$, where $\Delta V$ is the difference between input and lamp voltage, R is the ballast resistance, and $P_B$ is the ballast power.

To limit ballast power to 50% of previous value the switches are switched as follows: $\%V_2=(100+\%V_1)/2$ where $\%V_2$ is the lamp's next switching voltage, and $\%V_1$ is the previous voltage. The voltage levels for 120 volts input are:

| % | $V_L$ |
|---|---|
| 12.5 | 15.0 |
| 56.3 | 67.5 |
| 78.1 | 93.8 |
| 89.1 | 106.9 |

If the resistance R is known, $P_B=V_i^2(100-\%)^2/(100^2R)$, $P_L=V_i^2\%(100-\%)/(100^2R)$, and $I=V_i(100-\%)/(100R)$, where $P_L$ is lamp power in Watts and I is the current in Amperes. For a ballast resistance of 10Ω, the lamp powers for the examples above are 158, 709, 985, and 1119 Watts respectively. It is interesting to note that the lamp's overall electrical efficiency $P_L/(P_L+P_B)$ is equal to the lamp's voltage in percent and is for the above example equal to 89.1%.

Figure 5:
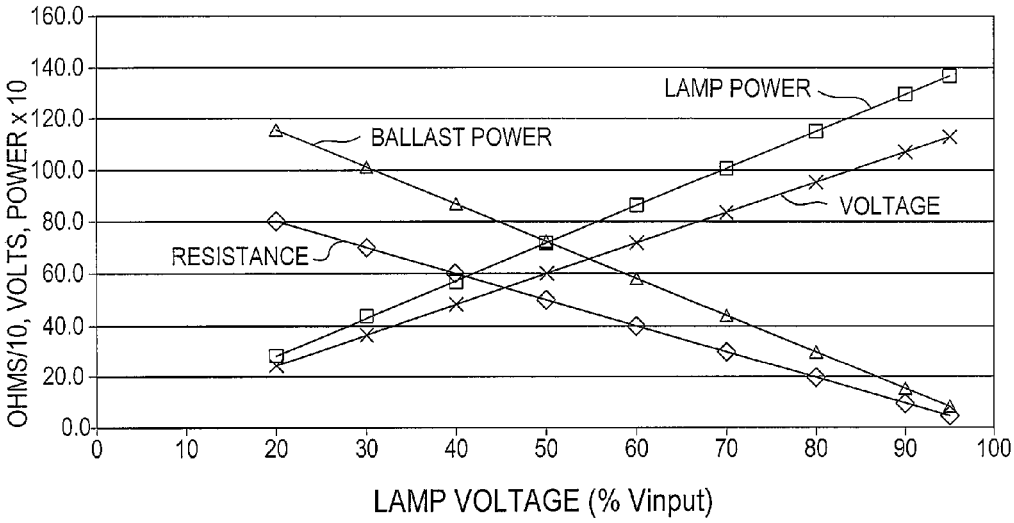
FIG. 5 is a graph of mercury lamp characteristics for a 7.5 cm lamp, 120VAC input, 12 amp current level, with resistance expressed as ohms/10, lamp voltage in volts, and ballast and lamp power in watts×10, all as a function of lamp voltage expressed as percentage of the input voltage.

FIG. 5 illustrates the lamp's characteristics with a constant 12-amp current level. For this example, the resistance of the ballast is decreased linearly by electronic means. As illustrated, the lamp's efficiency is low during warm-up but equals or exceeds that for a lamp with magnetic ballast (~0.85%) at its operating temperature. Since the resistance can be varied by a variety of methods, ballast cost can be targeted for various product designs.

To provide practical applications for resistive ballasted UV lamps, high power resistors are required, as are means to change their resistance as the lamp warms up. This can be accomplished with air-cooled resistance wire heating elements (e.g., made of Nichrome® or another nickel-chromium alloy) and semiconductor switching techniques to select the desired resistance value for the lamp temperature and voltage in order to keep the maximum ballast power below the limits described above.

A 2 kW magnetic ballast typically weighs about 30 kg and requires a volume of 8 $dm^3$, while the corresponding 2 kW resistive ballast will weigh only about 0.5 kg and occupy only about 1/10 the volume of the magnetic ballast. This allows for handheld UV curing systems with self-contained ballast that can operate directly from a 120VAC, 12 amp power outlet via a plug and electrical cord. Such readily portable equipment is adaptable to curing small areas, such as countertops, bathtubs, patchwork, silkscreen inks for labeling on small parts, etc., as well as doing lab work for coatings development.

With reference to FIG. 7, a hand held beam generator 11 is shown having a shell housing 12 and a lamp housing 17. The shell housing 12 has a handle 13 and a body portion 15. The body portion 15 and the handle 13 are connected together in the vicinity of a trigger switch 19 which controls power on and off to the unit. The shell housing 12 includes an air intake port 16 that allows outside air to pass into the shell housing under power of a motor, not shown. The lamp housing 17 is detachably connected to body portion 15, by means of screws. The lamp housing includes a reflector module 21 that defines a space or plenum where ultraviolet lamp 18 is mounted. The reflector is axially symmetric relative to the ultraviolet lamp 18, which in the case of a parabolic reflector resides along a focal line, allowing a collimated beam to be formed by the reflector. The reflector module may be made from symmetric halves with an air gap between the halves that allows air from the shell housing to pass into the plenum to influence the temperature of lamp 18. The body portion 15 encloses the variable resistance ballast, which may be a circuit such as that in FIGS. 6A and 6B. A secondary switch 22 may be used to control the speed of the motor. An electrical power cord 14 feeds ordinary AC power to the motor in the shell housing.

The resistive ballast variable resistor in FIG. 6B is used to counteract the negative resistance of the mercury vapor ultraviolet lamp 18. The ballast resistor prevents the lamp from drawing excessive current and provides electrical stability as the lamp warms. However, the temperature of the lamp will exceed the temperature of the air being blown across it from heating of the ballast resistor. As the lamp continues to heat up during operation, internal gas pressure within the lamp tube causes a higher voltage to be required to maintain the arc discharge. The higher voltage is not available through the ballast circuit. Since the voltage necessary to maintain the arc exceeds the voltage provided by the electrical ballast, the arc fails. The lamp goes out and begins to cool down. As gas pressure in the tube goes down, liquid mercury will form and the lamp's high-voltage multiplier circuit can be used to reignite the arc and send current again into the ballast resistor, plus heat blown across the Nichrome® wire resistor. This heats the lamp causing the lamp to glow and produce infrared light once again. This on-off cycle is inherent in the performance of the lamp and allows relatively high intermittent power to be obtained from a simple circuit.

UV Floor Curing Machine

Inherent in resistive ballasting is the use of short lamps (15 cm or less) that can be operated from either 120- or 220-volt outlets without transformers. Thus to cure large areas, the concept of rotating lamps has been devised. In these systems, two or more lamps rotate about a shaft suspended above the floor by centrally located wheels. Such systems have omnidirectional motion and extremely high peak-power levels since multi-kilowatt power is applied across short lamps. Such systems can operate from 120- or 220-volt outlets.

Figure 9:
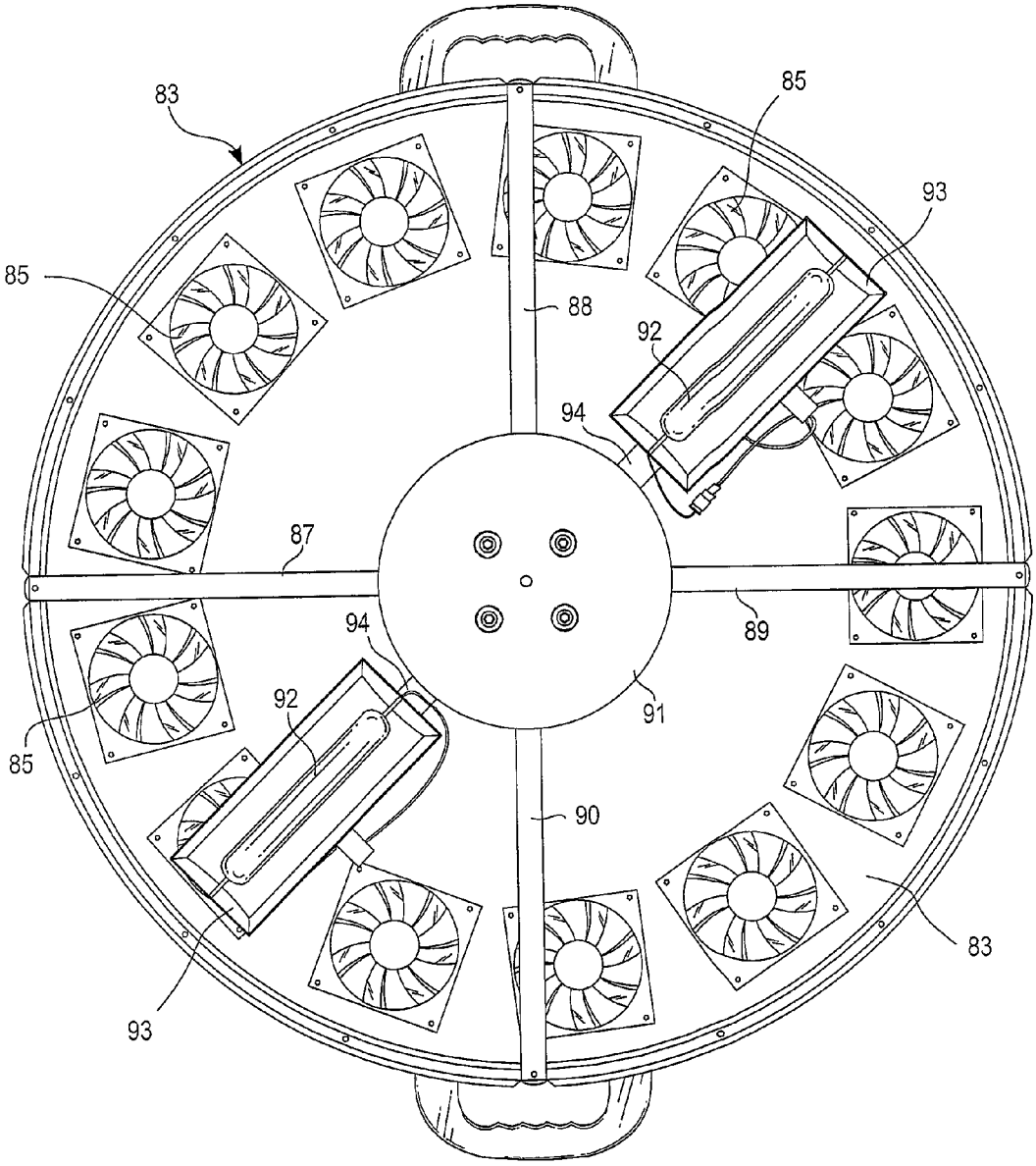
FIG. 9 is a bottom plan view of the floor model apparatus of FIG. 8.

With reference to FIGS. 8 and 9, a housing 83 containing a variable-resistance electric ballast system 82 are shown for a floor model with handle 81 for an operator to guide the UV curing apparatus across a floor. Housing 83 and electric ballast system 82, which enable the curing of UV curable coatings on larger floor surfaces, are an alternative embodiment of the handheld apparatus of FIG. 7. As seen from the underside in FIG. 9, a motor support 91 incorporates a motor (hidden behind support 91) into the housing for rotating lamps 92. Lamp arms 94 are attached to the motor rotated within the housing 83. Motor support 91 is connected to housing 83 by hub supports 87-90, which may be constructed of materials, such as sheet metal or plastic, that provides sufficient support for the motor and connected lamp structures 92-94. The bottom of the housing is at least partially open to enable transmission of the UV light to the floor and also entry of ambient air for venting of hot air by housing exhaust fans 85.

Lamp housings 93 contain UV lamps 92. The quantity and positioning of the UV lamps 92, lamp housings 93 and lamp arms 94 may all be varied. UV lamps 92 are connected to respective variable-resistance electric ballasts of the electric ballast system 82. The lamp housings 93 may be elongated structures that are parabolic in cross-section and constructed of sheet metal or plastic having reflective surfaces thereby enabling reflection of UV light emanating from UV lamps 92 as a downwardly directed linear beam onto a coating to be cured.

Rotary Lamp Variables

In operation, the UV lamps 92 may rotate to form a curing zone as the housing 83 is rolled across the floor. Since superportability implies short lamps, we investigate the curing pattern of a two-lamp system rotating on a 50 cm diameter spindle that in turn can be rotated by the operator at some convenient rotation. The pattern of a point (r) on the lamp then follows the equation of a double trochoid:

$$x=vt-r\,\mathrm{SIN}(2\pi\theta t)-R\,\mathrm{SIN}(2\pi\phi t)$$

$$y=R-r\,\mathrm{COS}(2\pi\theta t)-R\,\mathrm{COS}(2\pi\phi t) \quad (10)$$

where r=any point on the lamp, R=Machine radius, θ=the rotations per minute of the lamps, ϕ=the rotation per minute of the machine, v=forward speed of operator, and t=time in seconds. Although the spatial cure pattern for a single pass of the floor apparatus, a skilled operator will cover the entire floor similar to that with a rotary sanding machine.

UV Safety

Direct and reflected UV light from a 120 volt 1000 watt 7.5 cm handheld and 3 kW 50 cm diameter floor machine was measured with a WA meter in Watts/m$^2$:

| Handheld | | | Floor Machine | |
|---|---|---|---|---|
| Direct | | Reflected | Reflected | |
| 1 cm | 200 cm | 100 cm | 2 cm | 200 cm |
| 10000 | 1.5 | 0.3 | 1.5 | 0.01 |

while for comparison the afternoon Sun measures 15.5 W/m$^2$ in the UVA region. Accidental exposure at close range from any high power lamp can be dangerous. Direct exposure from within 1 meter of the handheld device can result in greater UV exposure than the afternoon sun. However, at normal operating distance, the exposure is ten and a thousand times less than the sun's exposure from the reflections of the hand-held and floor machine respectively, and should be treated appropriately with eye and skin protection, similar to that when working outdoors in the sun.

CONCLUSIONS

We have shown that it is feasible to operate mercury lamps with resistive ballasts making UV curing equipment significantly more portable and less costly than other UV curing technologies. Although resistive ballasts consume more power than the lamp during warm-up, it has been shown that UV systems with the variable-resistance ballasts of the present invention can achieve efficiencies equal to or greater than magnetic ballasts.

What is claimed is:

1. An ultraviolet beam generating apparatus, comprising:

a variable-resistance ballast electrically connected to one or more mercury vapor discharge lamps in a reflective lamp housing, the resistance provided by the ballast being selected as a function of lamp voltage to counterbalance the decreased resistance within the lamp discharge as operating power and temperature increases.

2. An ultraviolet beam generating apparatus, comprising:

a shell housing having a body and a handle connected to the body;

a lamp housing detachably connected to the shell housing and having a reflector with an axis;

an axially mounted ultraviolet lamp within the lamp housing along the axis of the reflector;

a variable-resistance ballast electrically connected to the lamp, the ballast having at least one resistance alloy wire element within the shell housing with a fan blowing air from the wire element over the lamp.

3. The apparatus of claim 2 wherein the resistance alloy wire element is composed of Nichrome.

4. The apparatus of claim 2 wherein a set of switches tap the resistance alloy wire at positions to provide a selectable set of variable resistance values.

5. The apparatus of claim 2 wherein the lamp has a temperature-dependent negative resistance property and the ballast has a temperature-dependent resistance that offsets the temperature-dependent negative resistance property of the lamp.

6. The apparatus of claim 2 wherein the ultraviolet lamp comprises a mercury vapor discharge lamp.

7. The apparatus of claim 2 wherein the ultraviolet lamp is a 3-electrode lamp.

8. The apparatus of claim 7 wherein one of said 3-electrodes is connected to a high-voltage start circuit.

9. The apparatus of claim 2 wherein the reflector is parabolic in shape.

10. The apparatus of claim 2 wherein the reflector is provided with at least one opening for allowing the blowing air to reach the lamp.

11. The apparatus of claim 10 wherein the reflector is axially split into symmetric halves.

12. The apparatus of claim 11 wherein the axially split reflector halves are supported by spaced apart ribs mounted on the lamp housing.

13. The apparatus of claim 2 wherein the shell housing is adapted to move along a floor guided by an operator using a handle attached to the shell housing.

14. The apparatus of claim 13 wherein the lamp housing and lamp are adapted to rotate within the shell housing.

15. A method of making an ultraviolet beam generator, comprising:

providing a variable-resistance ballast for an ultraviolet lamp within a housing, the ballast having at least one resistance alloy wire element within the shell housing with a fan blowing air from the wire element over the lamp;

placing an ultraviolet lamp in electrical and thermal communication with the ballast; and placing a beam-forming reflector around a portion of the UV lamp.

16. The method as in claim 14, wherein the resistance alloy wire element is composed of Nichrome.

17. The method as in claim 14, wherein the resistance is selected from among a set of resistance values defined by switches tapping different positions along the resistance alloy wire element.

18. The method as in claim 14, wherein the lamp has a negative temperature coefficient of electrical resistance and the ballast has a temperature-dependent resistance that offsets the negative temperature coefficient of the lamp.

19. The method as in claim 14, wherein the ultraviolet lamp comprises a mercury vapor discharge lamp.

20. The method as in claim 14, wherein the ultraviolet lamp is a 3-electrode lamp.

21. The method as in claim 20, wherein one lamp electrode is connected to a high-voltage start circuit.

22. The method as in claim 20, further defined by providing a voltage multiplier in a circuit having the variable-resistance ballast and connecting the voltage multiplier to a first and second electrode of the 3-electrode UV lamp.

23. The method as in claim 15, further defined by providing an axially split parabolic reflector for the lamp, the split providing at least one opening establishing a gas flow path to the lamp from behind the reflector.

24. The method as in claim 15, further defined by moving the shell housing along a floor guided by an operator using a handle attached to the shell housing.

25. The apparatus as in claim 24, wherein the lamp housing and lamp rotate within the shell housing.

* * * * *